US006664488B2

(12) United States Patent
Alexandre et al.

(10) Patent No.: US 6,664,488 B2
(45) Date of Patent: Dec. 16, 2003

(54) CONTACTOR WITH A FRONT MASK

(75) Inventors: Pascal Alexandre, Maule (FR); Regis Perrocheau, Couternon (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/168,499

(22) PCT Filed: Dec. 26, 2000

(86) PCT No.: PCT/FR00/03688

§ 371 (c)(1),
(2), (4) Date: Jun. 21, 2002

(87) PCT Pub. No.: WO01/50489

PCT Pub. Date: Jul. 12, 2001

(65) Prior Publication Data

US 2002/0192990 A1 Dec. 19, 2002

(30) Foreign Application Priority Data

Dec. 30, 1999 (FR) ..... 99 16805

(51) Int. Cl.[7] ..... H01H 31/00
(52) U.S. Cl. ..... 200/50.01
(58) Field of Search ..... 200/50.01–50.16, 200/337, 333

(56) References Cited

U.S. PATENT DOCUMENTS

| | | | | | |
|---|---|---|---|---|---|
| 3,317,698 | A | * | 5/1967 | Mansfield | 200/333 |
| 5,664,955 | A | * | 9/1997 | Arnett | 439/135 |
| 6,137,068 | A | * | 10/2000 | Padulo | 200/43.16 |

FOREIGN PATENT DOCUMENTS

| | | | | |
|---|---|---|---|---|
| DE | 29 50 438 A1 | | 6/1981 | |
| DE | 296 15 689 U1 | | 12/1996 | |
| FR | 2 199 185 | | 4/1974 | |
| JP | 6-139900 | * | 5/1984 | 200/333 |

* cited by examiner

*Primary Examiner*—Lynn Feild
*Assistant Examiner*—Phuong KT Dinh
(74) *Attorney, Agent, or Firm*—Parkhurst & Wendel, L.L.P.

(57) ABSTRACT

The invention relates to an electromechanical contactor, comprising a mobile push-piece which is connected to the contact support and can be accessed via a front face. A cover in the form of a plate is removably mounted on the front part (10*a*) of the housing (10), on fastening elements (17,19) provided for mounting an additional bloc. Said cover provides a means of masking the mobile push-piece (16) and has a transparent section (21) in front of the push-piece which prevents it from being activated manually without altering the ability of the device to display the state of the contactor.

7 Claims, 2 Drawing Sheets

CONTACTOR WITH A FRONT MASK

FIELD OF THE INVENTION

The present invention relates to an electromechanical contactor comprising a casing which houses a moving contact holder, the casing having a front portion equipped with connection terminals accessible through a front face, as well as a pushbutton which is connected to the contact holder and which is visible and accessible through the front face.

BACKGROUND OF THE INVENTION

Contactors of this type are currently used for controlling low voltage electrical loads. The fixing of an electromechanical ancillary block having an auxiliary signalling function or another function which may be used in an automation plan, on the front of the casing of such a contactor, is frequently provided. The ancillary block has auxiliary contacts and a mobile component positioned in such a way that it cooperates with the push-button of the contactor unit in order to control the auxiliary contacts. The ancillary block may be attached to the contactor unit so as to be removable, usually by means of catches provided on the front face of the casing. It turns out that the state of the contactor may be viewed according to whether the push-button is protruding or recessed relatively to the front face; on the other hand the push-button is also used for manually testing the proper operation of the contactor's mobile contact holder. Now it may be dangerous to carry out this test, which actually switches the load while the contactor is energized.

The object of the present invention is to prevent the push-button from being actuated manually, without affecting the possibility of viewing the state of the contactor, by taking advantage of the arrangements made on the front of the contactor's casing for providing fixation of a front ancillary block or by taking advantage of similar arrangements.

According to the invention, the contactor's casing provides on its front face and near the mobile pushbutton, fitting or snap-on catches, suitable for receiving an ancillary block which may be coupled with the push-button or suitable for mounting in the direction of the casing's height; a cover is removably assembled on the front portion of the casing so as to hide the push-button, by being mounted on the front portion of the casing by means of assembling shapes cooperating with the catches. In this manner, the mounting of the cover makes use of the existing catches for assembling an ancillary block and/or facilitates straightforward assembly as for an ancillary block.

Advantageously, the cover may be a small plate which has a transparent portion located in front of the push-button and a hollowed-out portion edged with guide grooves for fitting and sliding onto the catches, in the direction of the contactor's height; abutment shoulders provided at the end of the grooves preferably cooperate with abutment portions notably provided on the catches.

The cover preferably has a width substantially the same as that of the casing and a height such that the terminals remain accessible when it is assembled with the casing, while it provides on one long side a transverse surface adjacent to the terminals, making wiring easier.

BRIEF DESCRITPION OF THE DRAWINGS

A description of a non-limiting embodiment of the invention will be made hereafter with reference to the appended drawings.

DESCRITPION OF THE PREFERRED EMBODIMENTS

Figure 1:
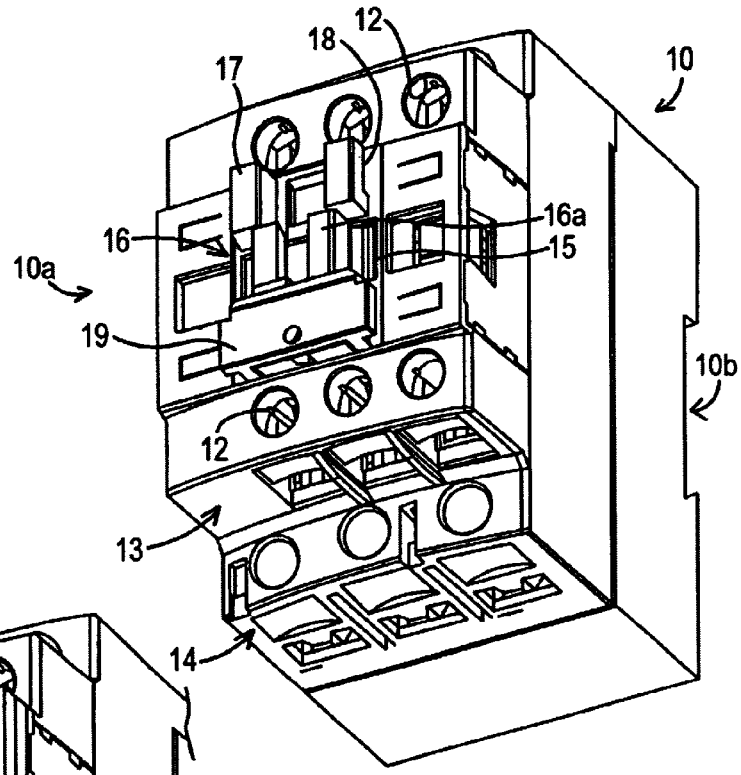
FIG. 1 shows a contactor in accordance with the invention, without any front cover, in perspective.

The contactor as shown comprises a casing 10 with a front portion 10*a* and a rear portion 10*b*. The rear portion 10*b* is designed to enable the contactor to be fixed onto a holder, whereas the front portion 10*a* has a front face 11 provided with apertures 12 for access to the terminals 13. In the present example, the terminals have a monitoring or controlling function, whereas the contactor's other terminals 14, i.e. power terminals, are located at the rear of the terminals 13. It is obvious that any other arrangement of the terminals may be provided, wherein the terminals 13 may in particular, be power terminals.

Figure 3:
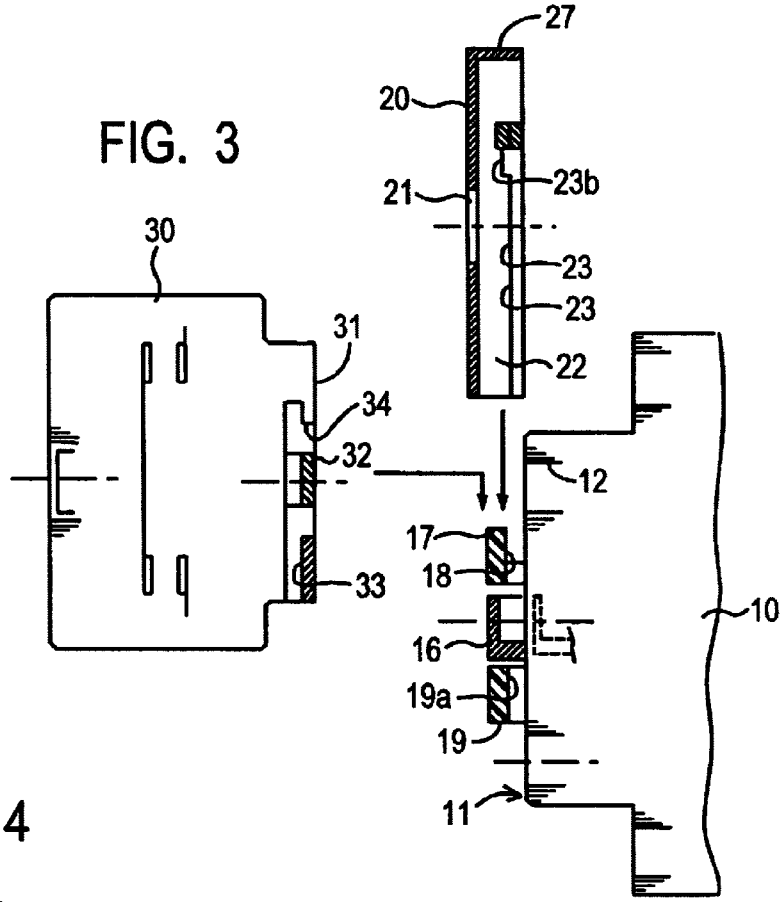
FIG. 3 is a diagrammatic elevational view showing the front portion of the contactor and an ancillary block or the cover not assembled together.
Figure 4:
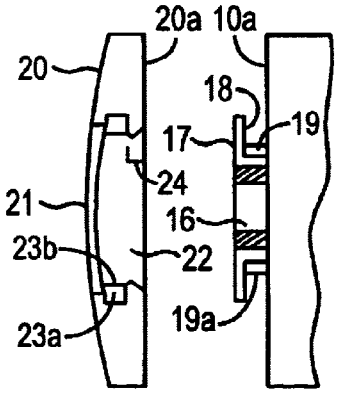
FIG. 4 is an exploded top view of the front portion of the contactor and the cover.
Figure 5:
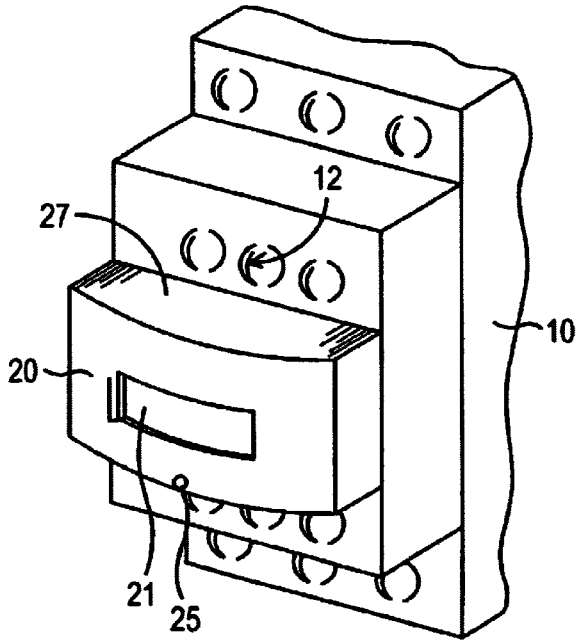
FIG. 5 shows the front portion of the contactor with the cover in perspective from above.

The front face 11 is provided with an opening 15 through which protrudes the free end 16*a* of a mobile push-button 16 either firmly joined or connected to a mobile contact holder, not shown, which is housed in the casing 10 and which is able to move perpendicularly to the front face 11 in response to the pull of an electromagnet. The end 16*a* of the push-button is protruding when the contactor is at rest (state illustrated in FIG. 1) and recessed when the contactor is activated. When an ancillary block 30 of auxiliary contacts is added to the contactor, as described later on with reference to FIG. 3, the push-button has the role of a driving unit for the ancillary block's own contact holder unit. In addition, the push-button has a testing function, enabling an operator to check, by pressing the push-button, whether the contactor is operating normally.

Provision is made for two fixed tenons 17 provided with grooves 18 towards the outside (to the left and to the right in FIG. 1) on the one hand and on the other hand a guide flange 19 next to the fixed tenons and provided with grooves 19*a* towards the outside, both protruding from the front face 11 of the casing 10. The grooves 18 and 19*a* enable the ancillary block 30 or a cover 20 to slide parallel to the front face 11 of the contactor and the direction of the contactor's height (direction indicated by the arrow in FIG. 3). Sliding the ancillary block or the cover enables them to catch on the fixed tenons 17 and the flange 19, here by fitting together. Additionally the tenons 17 have an abutment function for the ancillary block or the cover.

Figure 2:
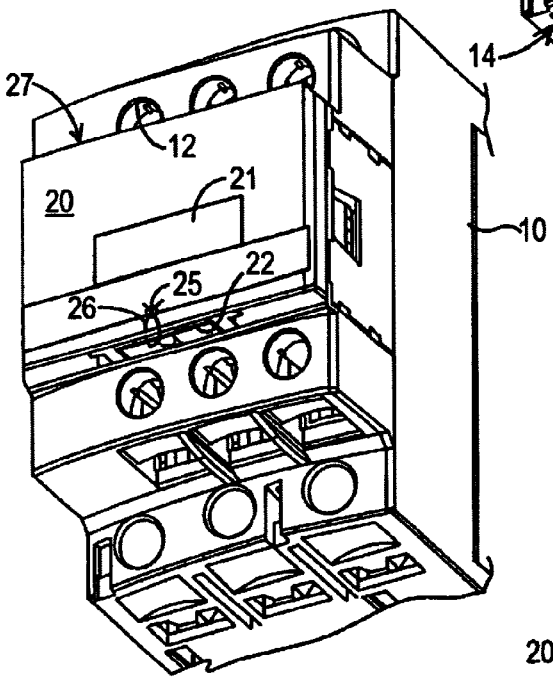
FIG. 2 is a same view showing the cover assembled with the casing of the contactor.
Figure 6:
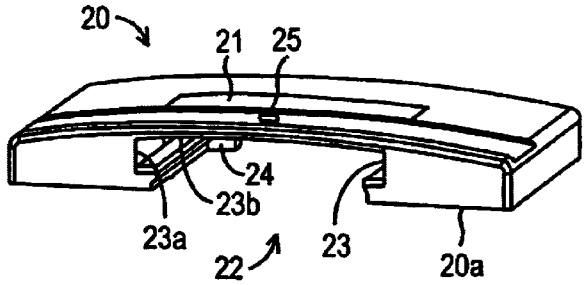
FIG. 6 is a perspective view of the cover.

The cover 20 is a small plate made of opaque insulating plastic material with a generally rectangular contour provided with a transparent central window-like portion 21 located, in the mounted position (FIG. 2), in front of the drive end 16*a* of the pushbutton 16, so that it is possible to see the state of the latter and consequently determine whether the contactor is in the on or off state. It is understood that at the same time the cover prevents the operator from carrying out any test operation.

The cover 20 comprises towards the front face 11 of the contactor a rear surface 20*a*, which comes into contact with the face 11, when fitted into place and is kept in close contact with this front face by clearance effects notably from the grooves 23. The cover 20 provides a hollowed-out portion 22 edged with guide grooves 23 so that it may be slid over the components 17, 19, with abutment shoulders 24 at the end of the grooves which cooperate with the tenons 17. The grooves 23 have a first portion 23*a* cooperating with grooves 19*a* and a second portion 23*b*, narrower than portion 23*a*, cooperating with grooves 18 (themselves being less far apart than grooves 19*a*). The cover may thus be engaged and held in place very easily, like a passive ancillary. In addition, a passage 25 for a lead sealing unit 26 which is intended for jamming the push-button, opens into the lower part of the hollowed-out portion 22. At its upper portion, the cover 20 provides a flat transverse surface 27 which facilitates wiring within the apertures 12 for accessing the terminals 13.

The ancillary block 30 has a rear surface 31 provided with a socket 32 which may move perpendicularly to the front face 11 of the casing 10 and which may be coupled onto the end 16*a* of the pushbutton 16. The block 30 may be applied onto the front face 11 (see FIG. 3). The ancillary block 30 has guide grooves 33 able to cooperate with the grooves 18 of the tenons 17 and with the grooves 19*a* of the flange 19. Shoulders 34 are provided on the edge of the grooves 33 so that they are applied against the tenons 17 at the end of travel during the fitting, according to the arrow in FIG. 3. It is obvious that if other means are provided for fitting or snapping the ancillary block onto the contactor's casing, the cover may be removably fixed to the front portion of the casing 10 by these means.

What is claimed is:

1. An electromechanical contactor comprising a casing that houses a mobile contact holder, the casing comprising a front portion having a front face and connection terminals that are accessible through the front face, and a mobile push-button that is connected to the contact holder and visible and accessible through the front face, the front face having catches located thereon and near the mobile push button; assembly shapes that cooperate with the catches by sliding parallel to a plane defined by the front portion; and a cover, wherein: the cover is removably attached to the front portion of the casing, for preventing actuation of the push-button, by being mounted on the front portion of the casing by the assembly shapes which cooperate with the catches by sliding parallel to a plane defined by the front portion.

2. The contactor according to claim 1, wherein the cover comprises a small plate that has a hollowed-out portion and the assembly shapes are guide grooves located along the edge of the hollowed-out portion that enable the small plate to be attached to the casing by sliding it over the catches.

3. The contactor according to claim 2, wherein the guide grooves are parallel to a plane defined by the front portion of the casing and are bounded by at least one abutment shoulder.

4. The contactor according to claim 1, wherein the assembly shapes of the cover are for locating the cover against the front face of the casing with a clearance therebetween so that a rear face of the cover is in close contact with the front face of the casing.

5. The contactor according to claim 1, wherein the cover comprises opaque plastic material and has a transparent portion located in front of the push-button.

6. The contactor according to claim 1, wherein the casing further comprises terminals accessible through the front face of the casing, the cover having a width substantially the same as that of the casing and a height such that the terminals remain accessible when the cover is assembled with the casing, and the cover has, on one long side, a transverse surface adjacent to the terminals.

7. The contactor according to claim 1, wherein a passage for a lead seal unit opens into the hollowed-out portion of the cover.

* * * * *